US005372062A

United States Patent [19]

Jonkka et al.

[11] Patent Number: 5,372,062

[45] Date of Patent: Dec. 13, 1994

[54] METHOD AND A PRESS FOR COMPRESSING MATERIAL HAVING TWO OPPOSED TRANSFER ELEMENTS EXACTING A GREATER PRESSING FORCE ON THE MATERIAL DURING A FORWARD MOTION THAN THE PRESSING FORCE EXERTED DURING A RETURN MOTION

[75] Inventors: Arvo Jonkka, Pori; Antti Tohkala, Rauma, both of Finland

[73] Assignee: Sunds Defibrator Woodhandling Oy, Pori, Finland

[21] Appl. No.: 94,186

[22] PCT Filed: Feb. 27, 1992

[86] PCT No.: PCT/FI92/00056

§ 371 Date: Aug. 2, 1993

§ 102(e) Date: Aug. 2, 1993

[87] PCT Pub. No.: WO92/15447

PCT Pub. Date: Sep. 17, 1992

[30] Foreign Application Priority Data

Feb. 27, 1991 [FI] Finland ..... 910979

[51] Int. Cl.[5] ..... B30B 9/02

[52] U.S. Cl. ..... 100/37; 100/41; 100/116; 100/144; 100/178; 100/264; 198/621; 198/750

[58] Field of Search ..... 100/35, 37, 41, 110, 100/113-116, 125, 144, 151, 154, 177, 178, 237, 264; 198/621, 750

[56] References Cited

U.S. PATENT DOCUMENTS

| | | | |
|---|---|---|---|
| 2,107,607 | 2/1938 | Göbel | 198/621 X |
| 2,271,599 | 2/1942 | Maurer | 100/144 |
| 2,278,552 | 4/1942 | Maurer | 198/621 |
| 2,340,607 | 2/1944 | Maurer | 100/144 |
| 3,564,994 | 2/1971 | Mosley | 100/144 X |
| 3,850,213 | 11/1974 | Keaton | 100/154 |
| 4,316,411 | 2/1982 | Keaton | 100/154 X |
| 5,134,929 | 8/1992 | Jonkka et al. | 100/37 |

FOREIGN PATENT DOCUMENTS 78020 6/1989 Finland .

*Primary Examiner*—Stephen F. Gerrity

*Attorney, Agent, or Firm*—Burns, Doane, Swecker & Mathis

[57] ABSTRACT

A method and press for pressing material by way of feeding the material into a gap formed between two pressing surfaces, in which gap the cross section of the material flow is tapered in the forward transfer direction of the material. The material is pressed between pressing surfaces formed by parallel, beam-shaped transfer elements which are reciprocatingly moved in the direction of material flow in two alternating groups so that the mutually opposed transfer elements of both pressing surfaces are moved in a mutually synchronized manner in the same direction. During the forward transfer motion the pressing force exerted by the transfer elements on the material is greater than the pressing force exerted during the return motion of the transfer elements.

15 Claims, 4 Drawing Sheets

METHOD AND A PRESS FOR COMPRESSING MATERIAL HAVING TWO OPPOSED TRANSFER ELEMENTS EXACTING A GREATER PRESSING FORCE ON THE MATERIAL DURING A FORWARD MOTION THAN THE PRESSING FORCE EXERTED DURING A RETURN MOTION

BACKGROUND OF THE INVENTION

The present invention relates to a method for pressing a material so that the material is fed into a gap formed by two pressing surfaces, in which gap the cross section of the material flow is tapered in the direction of the flow, and the material is compacted and pressed between pressing surfaces formed of parallel, beam-shaped transfer elements, which are reciprocatingly moved in the direction of the material flow so that the mutually opposed transfer elements of both pressing surfaces are moved in a mutually synchronized manner in the same direction and so that during the forward transfer motion the pressing force exerted by the transfer elements on the material is greater than the pressing force exerted during the return motion of the transfer elements. Furthermore, the invention concerns a press for compacting and pressing a material, said press comprising two opposed pressing surfaces whose mutual distance tapers in the direction of the material flow and which are formed by parallel, beam-shaped transfer elements provided with means for moving the elements in a reciprocating manner in the direction of the material flow so that the opposed transfer elements of both pressing surfaces are moved in a mutually synchronized manner in the same direction and so that during the forward transfer motion the pressing force exerted by the transfer elements on the material can be relaxed during the return motion.

Different types of presses are conventionally used for, e.g., dewatering bark resulting from debarking of wood in order to improve its solids content. The bark is used for firing, but prior to such a use, it must be dewatered. Dewatering has been accomplished by means of ram and roll presses of different types. Various constructions of presses have been described in, e.g., the Finnish patent publication 78020. A problem of conventional roll press implementations has arisen, i.a., from the feed of bark into the narrow nip of the press. The actual pressing time remains relatively short in roll presses, and consequently, it has been necessary to recirculate the bark several times through the pressing nip. Since the compressed bark, however, has a chance of decompressing between the nips, a part of the expelled water can re-enter the bark. Other problems have also been caused from the fact that the pressing surfaces perforated for the passage of expelled water must take extremely high backing forces. Discharge of water has generally been possible via only one of the surfaces, namely the lower pressing surface supporting the bark flow.

Transferring and pressing presses constructed from parallel, beam-shaped transfer elements are known from U.S. Pat. Nos. 2,271,599, 2,340,607 and 2,278,552, G. Maurer, and 3,850,213, D. Keaton, and 2,107,607, K. Göbel. These presses are not, however, designed for compacting and pressing a material of extremely high fluidity or liquid content. The presses disclosed in the foregoing patents are closest suited to pressing and transferring board-like products.

SUMMARY OF THE INVENTION

In the method according to the present invention the transfer elements are moved reciprocatingly in two alternating groups so that every second opposed pair of the transfer elements in turn perform a forward transfer motion, while the interleaved second pair perform a return motion. Furthermore, in the press according to the invention, the transfer elements are divided into two alternating groups in which every second opposed pair of the transfer elements in turn perform a forward transfer motion, while the interleaved second pair perform a return motion.

In the method according the invention the material is compacted and pressed by means of pressing surfaces approaching each other cyclically. These surfaces are formed by parallel, beam-shaped transfer elements, which are reciprocatingly moved under guidance by link arms in two groups so that the mutually opposed transfer elements of both pressing surfaces are moved in a mutually synchronized manner in the same direction and thereby move the material toward the opposed surface and perform compression of the material during each forward transfer motion. During the forward transfer motion the transfer elements with the help of the link arms exert a pressing force on the material which is greater than the pressing force exerted during the return motion of the transfer elements.

Thus, approximately half of the common pressing surface of the transfer elements is moved simultaneously as a group in the forward transfer direction, while the other group moves in the return direction. When the compressive pressure exerted by transfer elements moving in the forward transfer direction, and the common compressive force thereof as well, is greater than that of the transfer elements moving in the return direction, the required transfer force can be attained in the forward transfer direction.

The construction of the press according to the invention is extremely simple and rigid. The duration of the pressing action in the press can be arranged sufficiently long. During the travel of the material through the press, the compressive effect exerted on it becomes progressively stronger and the bulk of the material need not be allowed to decompress intermittently. The feed of the material is easy to arrange. The pressing surfaces can be aligned so that the material is hopper-fed between them from above, whereby the discharge of water is possible through both pressing surfaces. The size of the press can be easily increased by adding more transfer elements in parallel with the existing ones. If each transfer element is provided with an individual pressing-force exerting cylinder, the construction becomes compliant and yields without damage caused by, e.g. tramp stones travelling with the bark.

The novel apparatus according to the invention performs the treatment of the material as follows:

The fed material is compacted so as to remove void spaces.

Next, the forward transfer of the material is continued and liquid is expelled therefrom.

When the material reaches the discharge end of the press, it forms by virtue of its compacted composition a plug and thereby prevents flow of liquid from the non-pressed portion of the material to the pressed portion of the material.

The press according to the invention thus makes it possible to treat and press a highly fluid or wet material so that its volume after the press is only approx. 1/10 of the initial volume.

BRIEF DESCRIPTION OF THE DRAWINGS

The invention is next examined in greater detail by making reference to the appended diagrammatical drawings, in which.

DETAILED DESCRIPTION OF THE PREFERRED EMBODIMENTS

The opposed pressing surfaces of the press are comprised of a plurality of parallel, longitudinally aligned steel beams 1, 2 and 1', 2'. The mutual distance between the pressing surfaces formed by the beams tapers in the forward transfer direction. The beams are aligned to slant from vertical so that the forward transfer direction of the material is from above downwards. The beams of both pressing surfaces are divided in two equally large groups, which are alternatingly moved along a trajectory determined by link arms 4, 4', 5, 6, 6', 7, 9 and 10. The opposed transfer elements 1 and 1' are moved simultaneously in a mutually synchronized manner along an identical trajectory, while the transfer elements 2 and 2' are simultaneously moved in a mutually synchronized manner in the opposite direction.

Figure 2:
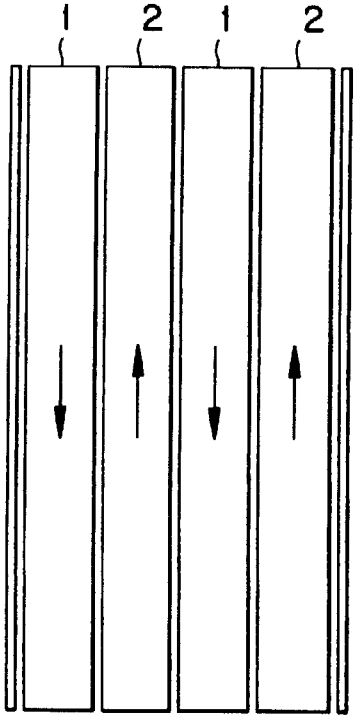
FIG. 2 shows a section II—II of the diagram of FIG. 1.
Figure 1:
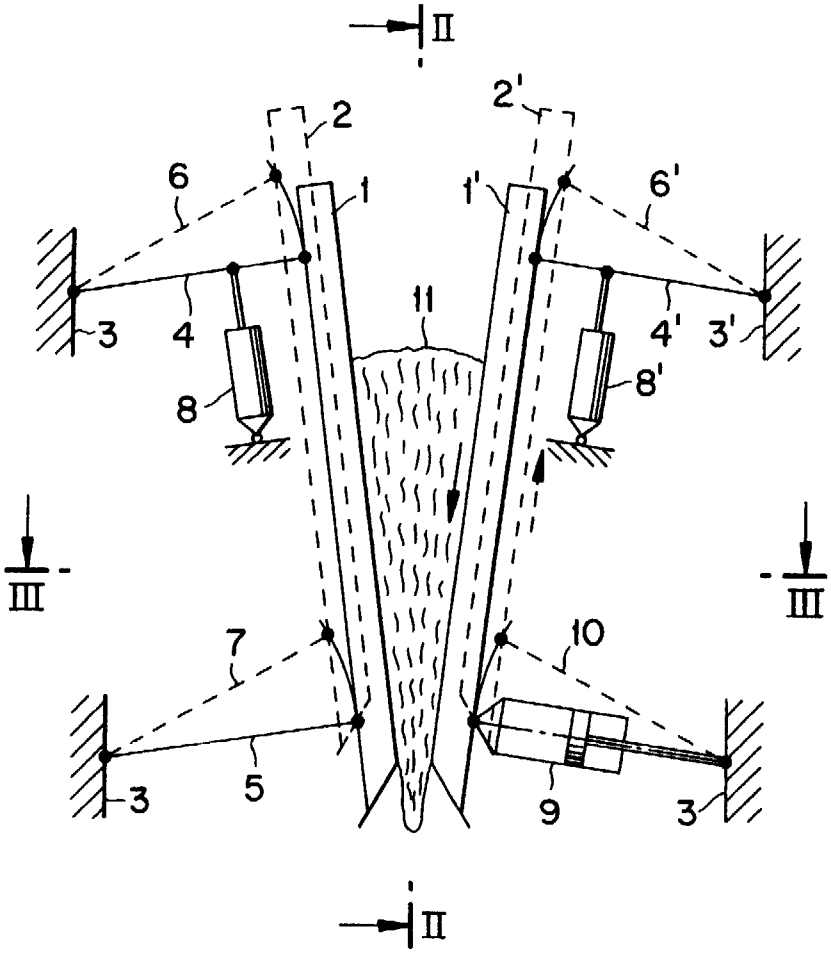
FIG. 1 shows in a side view an embodiment of the press according to the invention.

In the embodiment shown in FIGS. 1 . . . 3 the transfer elements 1 are supported on a frame 3 of the apparatus by means of two groups 4 and 5 of successively placed parallel link arms. The transfer elements 2 are correspondingly supported by means of successively placed link arms 6 and 7. The link arms 4 are connected to a hydraulic cylinder 8 that makes it possible to move the arms 4 reciprocatingly in such a manner in which that end of each arm connected to the transfer element 1 travels along a circularly curved trajectory in a plane parallel with the transfer element 1 and the opposed transfer element 1'. The arm 5 performs a corresponding motion. During the forward transfer motion the outer ends of the arms 4 and 5, and thereby the transfer elements 1 and the material to be compressed are moved toward the opposed transfer elements 1', while during the return motion they are moved away from the transfer elements 1'. In FIG. 1 both transfer element groups of both pressing surfaces are shown in their limit positions of approach.

Arms 6 of the transfer elements 2 are connected in a corresponding manner to a hydraulic cylinder (not shown in diagrams) and the transfer elements 2 perform as a group a similar reciprocating motion as that of the transfer elements 1 synchronized, however, to move in the opposite direction.

The transfer elements 1' are also supported in a similar manner, but having one of the link arm groups replaced by compliant link arms, e.g., hydraulic cylinders 9. The transfer elements 2' are provided with equivalent cylinders 10.

The material 11 is fed between the pressing surfaces from above, from where it moves cyclically downward undergoing compaction due to the progressively diminishing distance of the pressing surfaces and reduction in the volume required by the material. Water is discharged via holes fabricated in the transfer elements.

Figure 3:
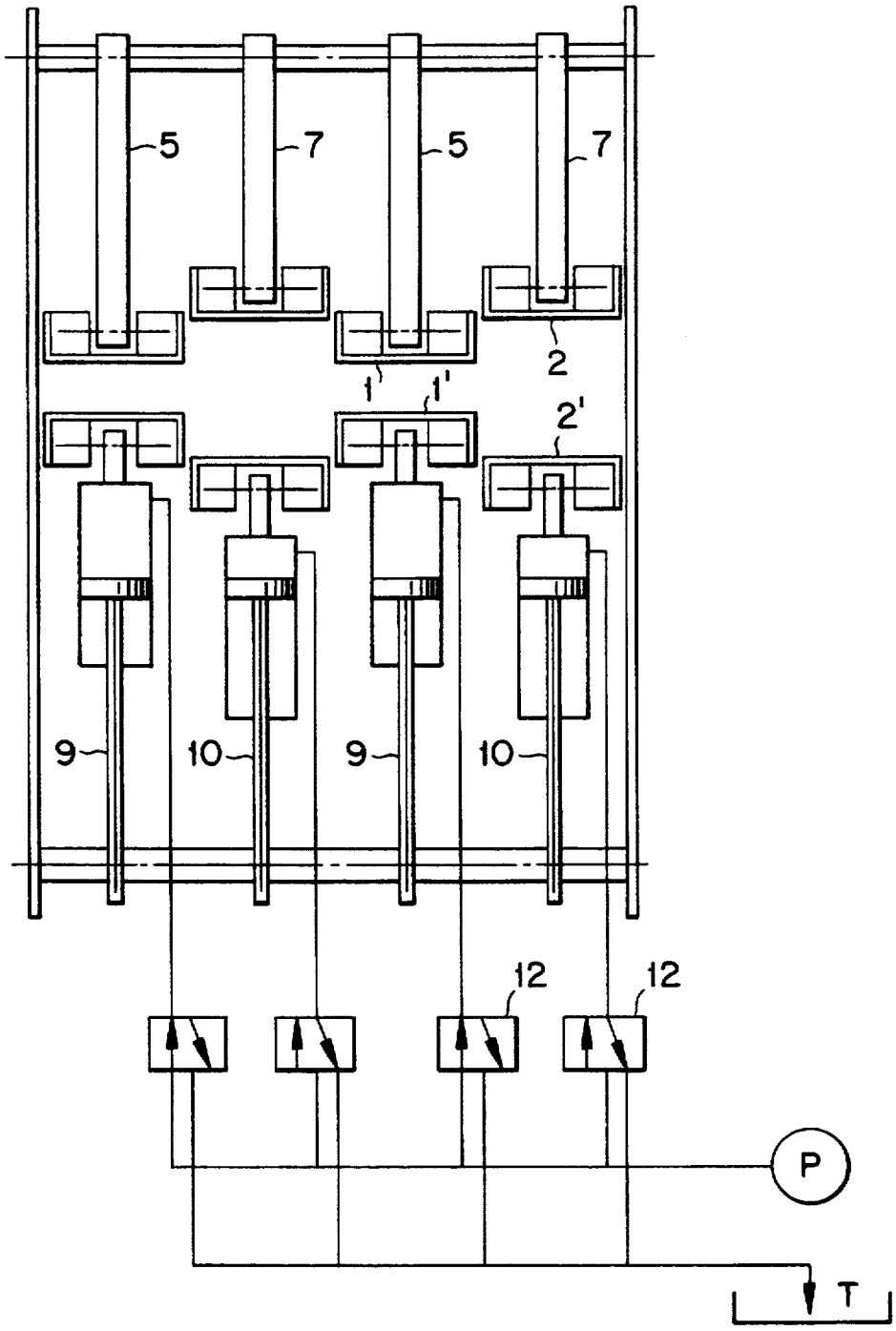
FIG. 3 shows a section III—III of the diagram of FIG. 1.

FIG. 3 illustrates the function of the hydraulic cylinders 9, 10. The feed of the material 11 is accomplished through augmentation of the transporting motion of the downward moving transfer elements 1 and 1' in the forward transfer and compression direction by means of compressing cylinders 9, whose hydraulic oil pressure from a hydraulic oil pump P is controlled by a control valve 12. When the motion of the transfer element 1 reaches its lower position and the return motion starts, the control valve 12 is toggled and the hydraulic oil pressure can discharge to a tank T. Due to this arrangement, the transfer elements 2 and 2' touch only lightly the material 11 to be pressed during their return motion. The return motion of the transfer elements is also relaxed by the advantageous positioning of the link arms 6, 6', 7 and the hydraulic cylinder 10.

Figure 4:
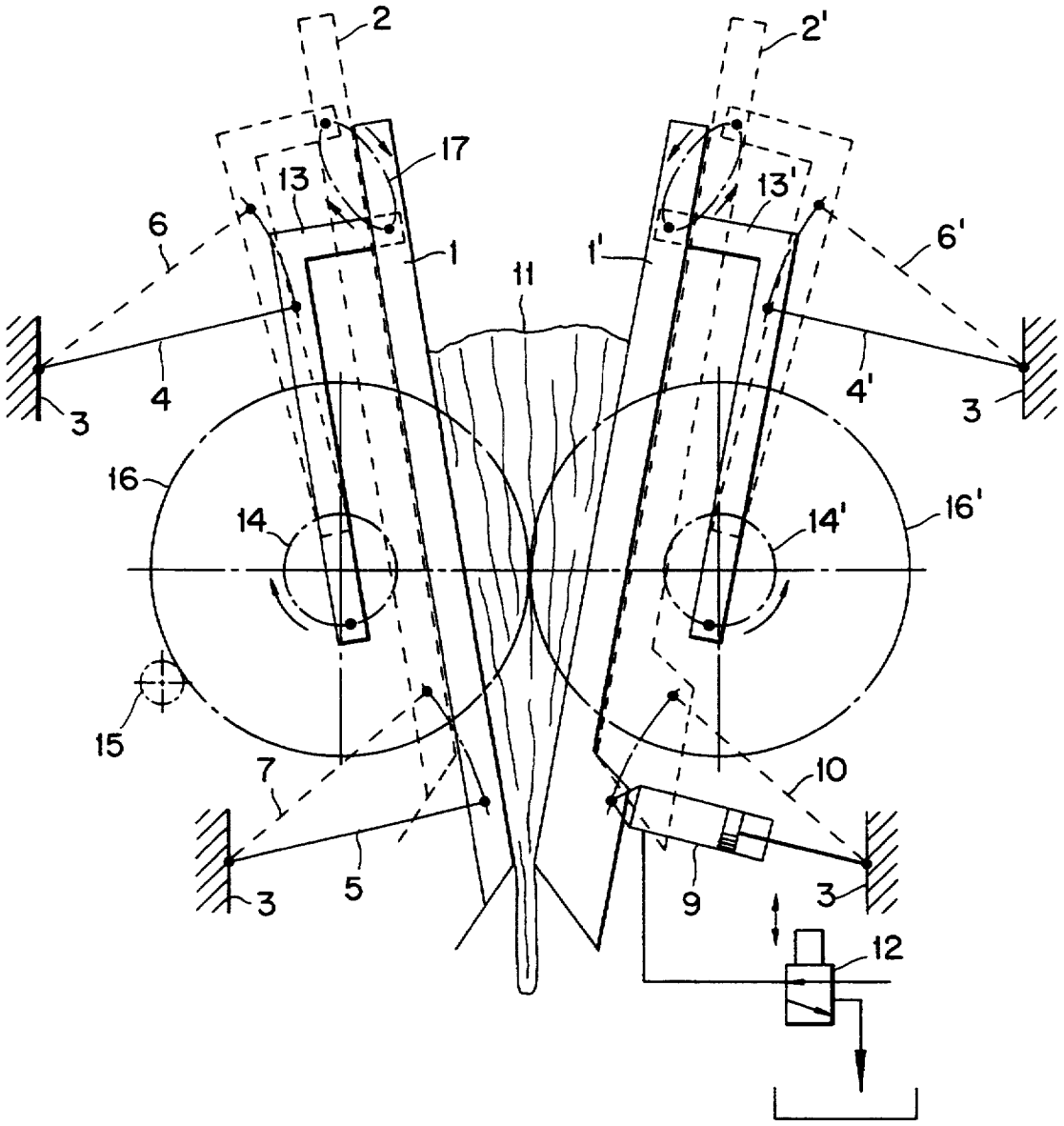
FIG. 4 shows in a side view another embodiment of the press according to the invention.
Figure 5:
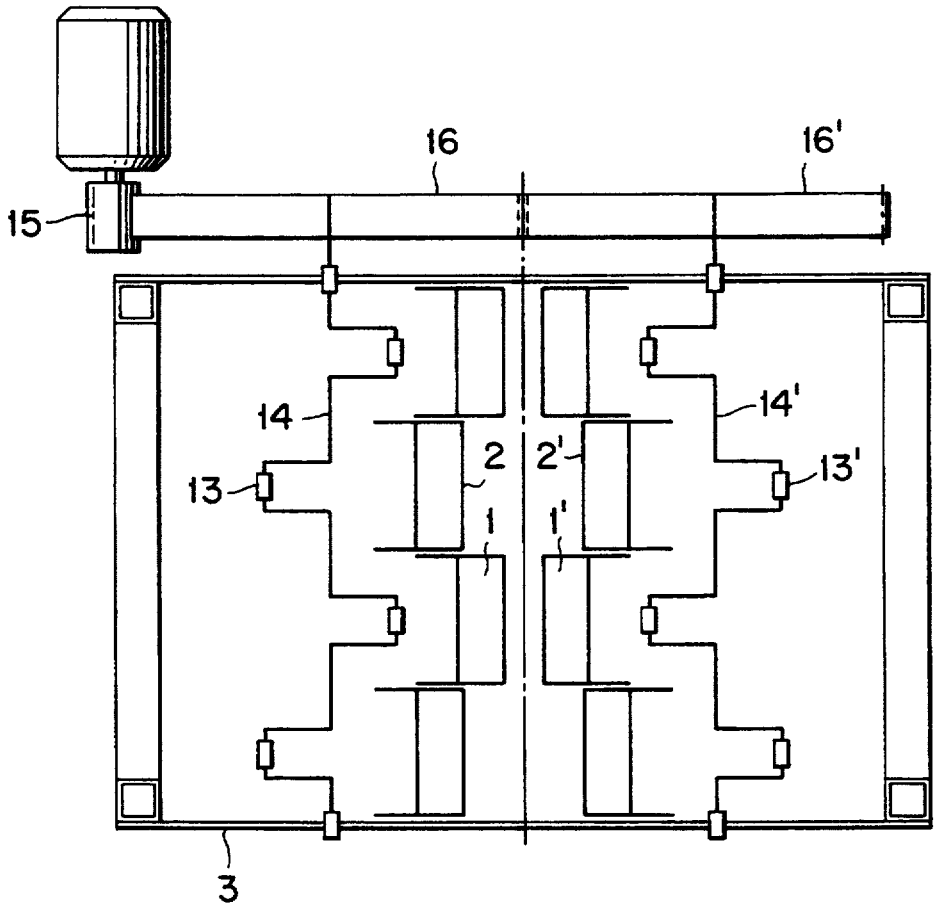
FIG. 5 shows a section of the diagram of FIG. 4 at the drive shaft assembly.

FIGS. 4, 5 show a press in which the hydraulic cylinders 8, 8' actuating the forward transfer motion are replaced by a mechanical drive system. Each transfer element 1, 2, 1', 2' has its one end pivotally connected to an intermediate link arm 13, 13', which further is pivotally connected to the link arm 4, 6, 4', 6'. The other end of the intermediate link arm 13, 13' is connected to a crankshaft 14, 14'. A driving gear 15 rotates on the opposed side a driven gear 16, which in turn rotates a gear 16' of equal size on the opposing side. The gears 16, 16' rotate each of their own crankshaft 14, 14'. The crankshafts bestow the transfer elements via the intermediate link arm 13, 13' a forward transfer motion which acts compactingly and compressingly on the material 1 in its forward transfer direction and releasingly from the material to be pressed in the return direction. The uppermost pivotal joint of the transfer element performs a motion along an elliptical trajectory 17. The hydraulic cylinder 9 functions in a similar manner as in the press illustrated in FIGS. 1 . . . 3.

We claim:

1. A method for pressing a material, comprising the steps of:

feeding the material into a gap formed between two pressing surfaces, in which gap the cross section of the material flow is tapered in the forward transfer direction of the material;

compacting and pressing the material between the pressing surfaces formed by parallel, beam-shaped transfer elements;

reciprocatingly moving the transfer elements in the direction of the material flow such that the mutually opposed transfer elements of both pressing surfaces are moved in a mutually synchronized manner in the same direction, the transfer elements being moved in two alternating groups so that every second opposed pair of the transfer elements in turn perform a forward transfer motion, while the interleaved second pair perform a return motion, such that during the forward transfer motion the pressing force exerted by the transfer elements on the material is greater than the positive pressing force exerted during the return motion of the transfer elements;

cyclically compacting and pressing the material between the transfer elements such that the transfer elements performing the forward transfer motion move the material toward the pressing surface of the opposed transfer elements so that void spaces and liquid are expelled from the material; and exerting a force to form the material into the gap between the transfer elements by compliant support elements, the material in the gap acting as a compacted plug which prevents the escape flow of liquid from the non-pressed portion of the material to the pressed portion of the material and expands the gap between the lower ends of the transfer elements in accordance with the volume and compressibility properties of the fed material.

2. A method as defined in claim 1, wherein during the forward transfer motion the distance of the transfer elements from the opposed pressing surface is decreased and during the return motion increased.

3. A press for compacting and pressing a material, said press comprising:

two opposed pressing surfaces spaced apart at a distance which is tapered in the direction of the material flow, said surfaces comprising parallel, beam-shaped transfer elements and means for moving said elements reciprocatingly in the direction of the material flow such that the mutually opposed transfer elements of both pressing surfaces are moved in a mutually synchronized manner in the same direction, moving the transfer elements in two alternating groups in which every second opposed pair of the transfer elements in turn perform a forward transfer motion, while the interleaved second pair perform a return motion such that during the forward transfer motion the pressing force exerted by the transfer elements on the material is greater than the positive pressing force exerted during the return motion;

means for compacting and pressing the material cyclically between the transfer elements such that the transfer elements performing the forward transfer motion move the material toward the pressing surface of the opposed transfer elements so that void spaces and liquid are expelled from the material;

compliant support elements for exerting a force to form the material into the gap between the transfer elements, the material in the gap acting as a compacted plug which prevents the escape flow of liquid contained in the material from the non-pressed portion of the material to the pressed portion of the material and expands the gap between the lower ends of the transfer elements in accordance with the volume and compressibility properties of the fed material.

4. A press as defined in claim 3, further comprising at least two successively placed link arms for supporting the transfer elements, said arms supported on a frame and movable such that during the forward transfer motion the outer ends of said arms connected to their respective transfer elements approach the opposed pressing surface along a circularly curved trajectory, while during the return motion said respective transfer elements are moved away from the opposed pressing surface.

5. A press as defined in claim 4, further comprising a hydraulic cylinder connected to at least one of the pressing surfaces for exerting a pressing force.

6. A press as defined in claim 5, further comprising hydraulic cylinders connected to the transfer elements for actuating the forward transfer motion.

7. A press as defined in claim 5, further comprising a crankshaft connected to the transfer elements for actuating the forward transfer motion.

8. A press as defined in claim 4, further comprising hydraulic cylinders connected to the transfer elements for actuating the forward transfer motion.

9. A press as defined in claim 4, further comprising a crankshaft connected to the transfer elements for actuating the forward transfer motion.

10. A press as defined in claim 3, further comprising a hydraulic cylinder connected to at least one of the pressing surfaces for exerting a pressing force.

11. A press as defined in claim 10, further comprising hydraulic cylinders connected to the transfer elements for actuating the forward transfer motion.

12. A press as defined in claim 10, further comprising a crankshaft connected to the transfer elements for actuating the forward transfer motion.

13. A press as defined in claim 3, further comprising hydraulic cylinders connected to the transfer elements for actuating the forward transfer motion.

14. A press as defined in claim 3, further comprising a crankshaft connected to the transfer elements for actuating the forward transfer motion.

15. A press as defined in claim 14, further comprising:

at least two successively placed link arms for supporting the transfer elements, said arms supported on a frame and movable such that during the forward transfer motion the outer ends of said arms connected to their respective transfer elements approach the opposed pressing surface along a circularly curved trajectory, while during the return motion said respective transfer elements are moved away from the opposed pressing surface; and an intermediate link arm pivotally connected between the crankshaft and one of the transfer elements, said intermediate link arm being further pivotally swivelled to one of the successively placed link arms wherein the pivotal connection between said intermediate link arm and said one of the transfer elements performs its motion along an elliptical trajectory.

* * * * *

UNITED STATES PATENT AND TRADEMARK OFFICE

CERTIFICATE OF CORRECTION

PATENT NO. : 5,372,062

DATED : December 13, 1994

INVENTOR(S) : ARVO JONKKA et al.

It is certified that error appears in the above-indentified patent and that said Letters Patent is hereby corrected as shown below:

IN THE TITLE: Item [54] and Column 1, line 1

After "Elements" the word "EXACTING" should be changed to --EXERTING--.

Signed and Sealed this

Twenty-first Day of February, 1995

*Attest:*

Bruce Lehman

BRUCE LEHMAN

*Attesting Officer*

*Commissioner of Patents and Trademarks*